US006128994A

United States Patent [19]

Phelps

[11] Patent Number: 6,128,994

[45] Date of Patent: Oct. 10, 2000

[54] ONE MAN CIRCULAR SAW MILL

[76] Inventor: Raleigh Hurtle Phelps, 655 Wakefield St., Bowling Green, Ky. 42103

[21] Appl. No.: 09/106,832

[22] Filed: Jun. 29, 1998

Related U.S. Application Data

[60] Provisional application No. 60/051,375, Jul. 1, 1997.

[51] Int. Cl.[7] ..... B27B 5/065; B27B 31/00; B27B 7/00

[52] U.S. Cl. ..... 83/471.2; 83/167; 83/452; 83/488; 83/102.1; 144/378

[58] Field of Search ..... 83/102.1, 109, 83/112, 113, 167, 452, 471.2, 477.1, 485, 150, 153, 488, 157; 144/378, 376, 377; 269/290

[56] References Cited

U.S. PATENT DOCUMENTS

| | | | |
|---|---|---|---|
| 720,400 | 2/1903 | Brown | 83/113 |
| 946,336 | 1/1910 | Class | 83/109 |
| 3,747,457 | 7/1973 | Thompson | 83/471.2 |
| 4,104,944 | 8/1978 | Janssen | 83/471.2 |
| 4,262,572 | 4/1981 | Flodin | 83/471.2 |
| 4,753,144 | 6/1988 | May | 83/102.1 |
| 5,036,738 | 8/1991 | May | 83/102 |
| 5,046,391 | 9/1991 | Lewis et al. | 83/489 |
| 5,109,899 | 5/1992 | Henderickson | 144/378 |
| 5,568,759 | 10/1996 | Aardema | 91/461 |

*Primary Examiner*—Rinaldi I. Rada
*Assistant Examiner*—Boyer Ashley

[57] ABSTRACT

The circular saw mill has an engine driven circular saw on a carriage. The carriage has a table that catches the sawn lumber and caries it back to the operator. The saw mill is laid out so one man can operate the mill, which eliminates the necessity for extra help. The set works for the saw mill has a hand lever at the operator station so the operator can advance the log towards the saw, controlling the thickness of the board to be cut. The log is held in a position for cutting by conventional dog asssemblies. The carriage is moved by a conventional chain and sprocket mounted on a hydraulic motor powered by a hydraulic power unit.

4 Claims, 4 Drawing Sheets

ONE MAN CIRCULAR SAW MILL

This application claims of provisional Application No. 60/051,375 filed Jul. 01, 1997.

CROSS-REFERENCES TO RELATED APPLICATIONS

None.

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

The present invention is a saw mill with a circular saw that is operable by one man.

2. Description of Prior Art

A screening search was run by Richard C. Litman, Registered Patent Attorney, and the following patents were discovered:

| | | |
|---|---|---|
| 4,753,144 | 06/28/88 | May |
| 5,036,738 | 08/06/91 | May |
| 5,046,391 | 09/10/91 | Lewis et al. |
| 5,109,899 | 05/05/92 | Henderickson |
| 5,568,759 | 10/29/96 | Peterson |

Owners of tree farms want to maximise their return on investment in land and labor growing the trees. Owners of relatively small scale tree farms, under 500 acres for example, have a problem in maximising their returns on investments if they sell the trees directly to saw mills, or indirectly through logging contractors. Logging contractors usually want to clear cut, as opposed to selectively cut timber. Harvesting a few trees at a time is not of interest to most logging contractors.

Existing saw mill technology is such there is not an efficient one man saw mill. By this is meant that there is not, presently, a saw mill that can be efficiently operated by one man. Small mills exist, that are somewhat efficient, but they are typically set up so that for efficient operation, as many as four men would be required. The four men would include a sawyer, a log turner, and two men loading and unloading lumber. While devices exist for automating some of those functions requiring the manpower, those devices are expensive. Without an efficient one man saw mill, an owner of a relatively small scale tree farm cannot selectively harvest individual trees and process them into lumber in an efficient manner. Also, the extra help required for efficient operation of existing small mills increase the possibility of accidents. The kind of extra help an owner of a relatively small scale tree farm is able to hire is not necessarily the most safety conscious help available on the labor market.

Mills exist that use band saws as well as electric motor driven saw blades. Limitations to band saw blades includes a relatively short service life between sharpenings as compared to circular saws. Circular saws are much faster than band saws. Also, many people, such as the Amish, do not favor electricity.

As will be seen in the subsequent description of the preferred embodiment of the present invention, these and other deficiencies in the prior art are overcome.

SUMMARY OF THE INVENTION

The present invention is a circualr saw mill operable by one person wherein an engine powered circular saw is mounted on a carriage that includes a platform for catching boards or slabs as they are sawn from a stationary log. The carriage mounted circular saw is moved through the log to saw slabs or boards from the log. The platform on the carriage catches the board or slab as it is sawn from the log. When the carriage returns to the operator of the saw mill, the operator can unload the sawn wood from the carriage as convenient.

DESCRIPTION OF THE PREFERRED EMBODIMENTS

Figure 1:
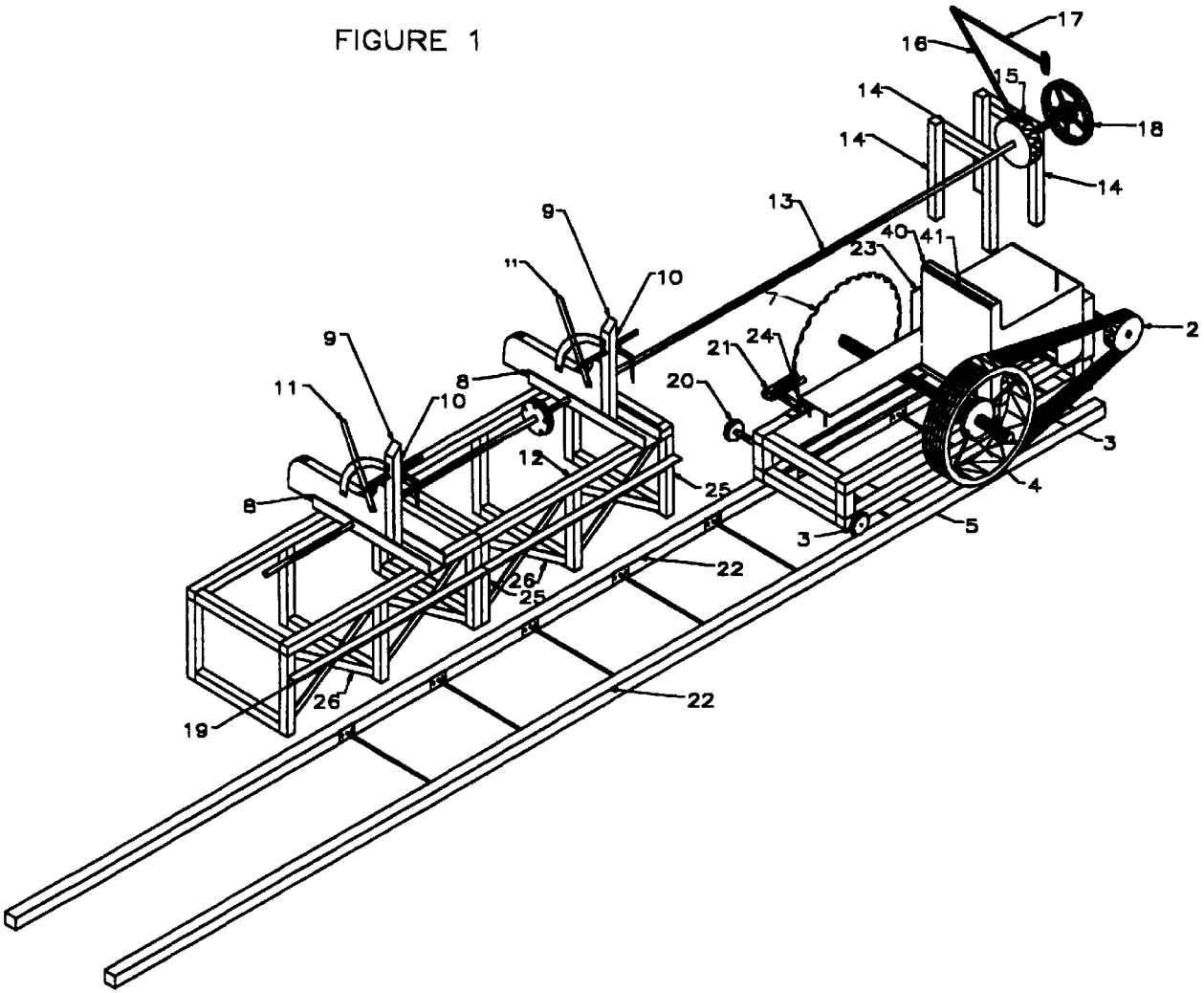
FIG. 1 is a perspective view of the preferred embodiment of the present invention.
Figure 2:
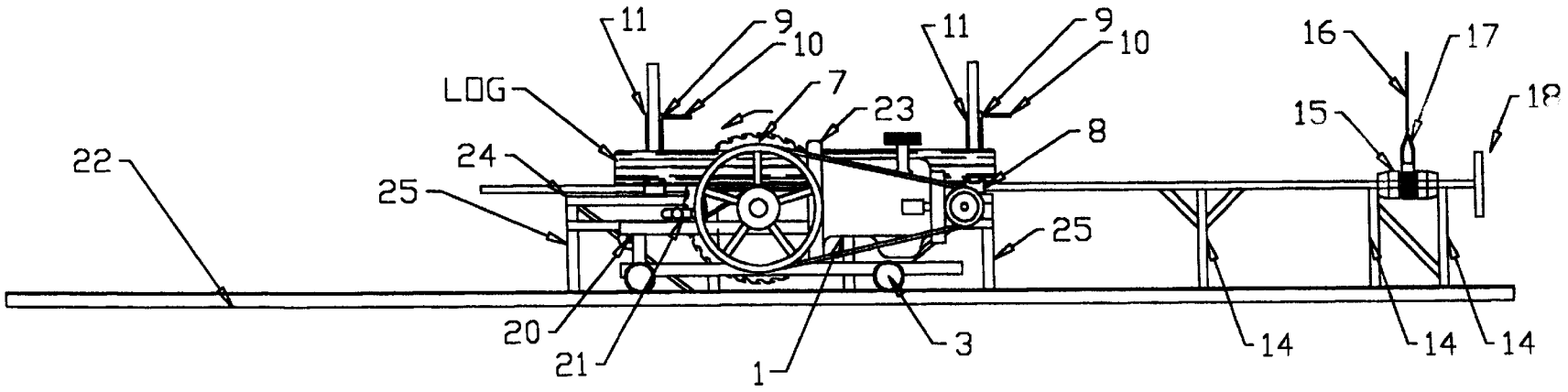
FIG. 2 is a top view looking diagonally down on the present invention showing a log secured by dogs laying on blocks with a portion of the log being sawed off.
Figure 3:
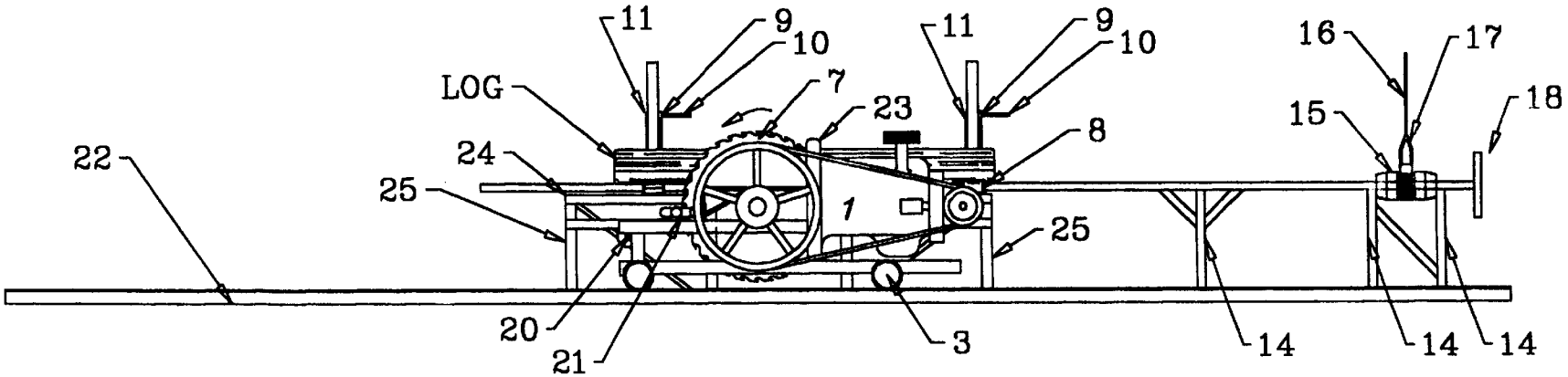
FIG. 3 shows a log secured by dogs laying on blocks with the sawn board laying on a lumber table which is returning to the operator.
Figure 4:
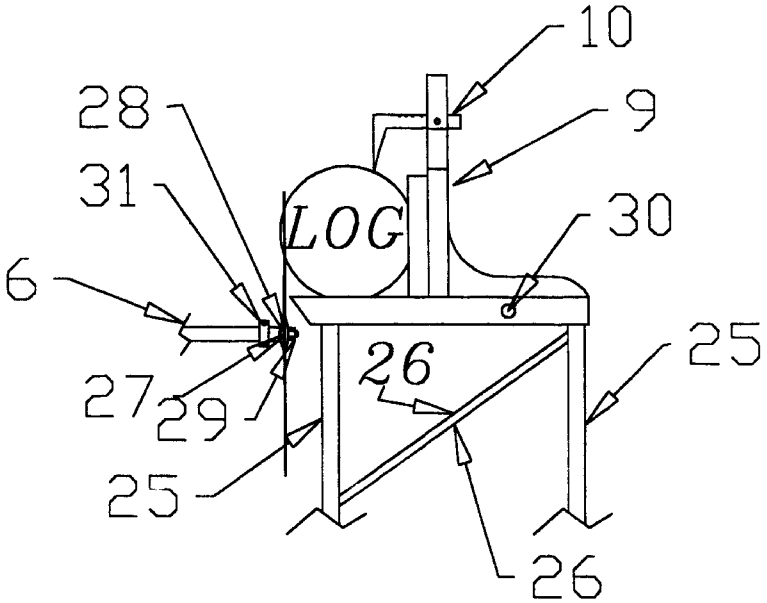
FIG. 4 is a breakaway end view of a portion of a saw mill showing the blocks and uprights with a flat face end view of a log secured to an upright by the dog as the saw makes contact with the log.
Figure 5:
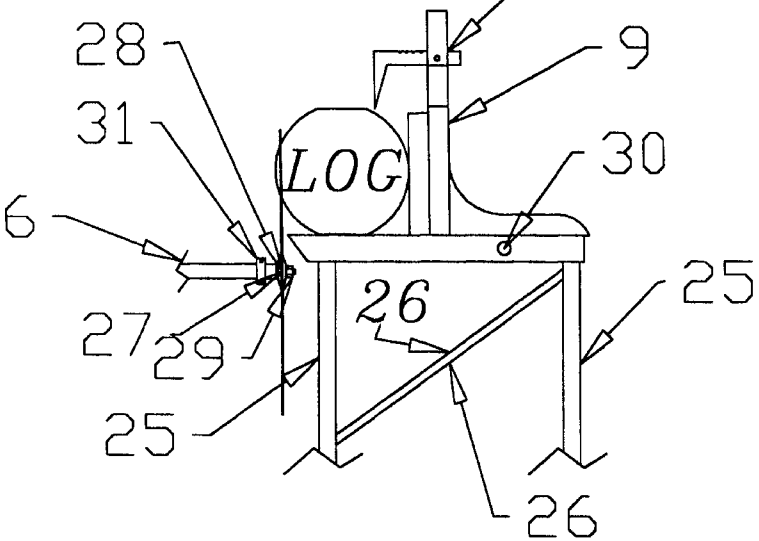
FIG. 5 is the front end view of the same part of the saw mill as in FIG. 3, showing a log with a slab removed from two sides leaving two flat parallel surfaces with one surface laying on the blocks and the other at the top secured with a dog as the saw makes contact with the log.

FIGS. 1 through 5 show the preferred embodiment of the present invention, a one man circular saw mill. The saw mill comprises a carriage frame 5 which is mounted on wheels 3 which ride on tracks 22. As shown in FIG. 1, the carriage frame 5 comprises a circular saw assembly 40 which comprises an engine 1, a small pulley 2, a large pulley 4, a saw shaft 6, a lumber table 24, a saw guide 21, a circular saw blade 7, a lumber splitter 23, and bearings 31. The bearings 31 are used to mount the saw shaft 6 horizontally on the carriage frame 5. The circular saw blade 7 is mounted on one end of the shaft 6 and secured by an inside stationary collar 27 (Ref. FIG. 4) and a removable collar 28 (Ref. FIG. 5) on the outside of the saw blade 7 secured by a large nut 29 (Ref. FIG. 4).

The crux of the invention is the carriage 5 with the lumber table 24 which catches each piece of lumber as it is sawn and then carries the lumber back to an operator as the operator is positioning the carriage 5 with the circular saw assembly 40 for the next saw cut through a log. The sawed off piece of lumber falls naturally in place on the lumber table 24 as it is sawn from the log. The operator controls everything from his station near a hand lever 17, except for installing a log into the dog assemblies 10 as required. Means of setting, holding, and positioning the log, and the means of transporting the carriage 5 are not inventive in themselves, but are detailed in this specifictation to provide sufficient information for one skilled in the art to duplicate what is required to support the invention and make it work efficiently. The circular saw assembly 40 on the carriage 5 along with the table 24, powered by an engine, sawing through and catching lumber as it is sawn from a log held stationary is unique. An arrow shows the direction of rotation of the circular saw blade 7 in the preferred embodiment of the present invention. This is a safety precaution to preclude lumber thrown by the circular saw blade 7 in the direction of the operator. This is fast and efficient as compared to the prior art discussed earlier.

FIGS. 4 and 5 show that blocks 8 are mounted high enough on a frame 12 to allow the end of the saw shaft 6, the large nut 29, and the removable saw collar 28 to pass under the beveled end of the blocks 8 when the circular saw assembly 40 is moved through the log to make a cut. A saw guide 21 is mounted on the carriage frame 5 at the front of the circular saw blade 7 which prevents lateral movement of the circular saw blade 7 when it is cutting a line. At the back edge of the circular saw blade 7 is the lumber splitter 23 which is a knife type lumber splitter, thin on the front edge, 3.5 inches wide and 12 inches high and aligned with the circular saw blade 7 so as to enter the kerf just made by the circular saw blade 7, in the preferred embodiment of the present invention. The flat surface of the lumber splitter 23 is against the log with the thicker part at the back edge keeping the board away from the saw teeth.

FIG. 3 shows a board which has been sawed off laying on the lumber table 24 which is mounted on the carriage frame 5. When the carriage frame is returned to the operator end for another cut, this lumber is carried back for removal by the operator. The operator end is the same end as a ratchet wheel 18 shown to the right of the FIG. 3. A large pulley 4 is mounted on the opposite end of the saw shaft 6 which is being driven by a smaller pulley 2 secured to the engine 1 shaft by a key and setscrew, in the preferred embodiment of the present invention. Power is transferred from the small pulley 2 to the large pulley 4 by V belts, in the preferred embodiment of the present invention.

Logs are supported by a log support frame 12 constructed of heavy gauge angle iron in the preferred embodiment of the present invention. The log support frame 12 is rectangular standing on upright support members 25 secured to a frame of like construction at the bottom. All corners at the bottom have right angles with the upright square and plumb, having cross members 26 to maintain its stance. The log support frame 12 is located parallel to and on a common plane to the track 22. The log support frame is located along a track 22 at a place which allows the carriage frame 5 to move back far enough to the operator end to leave a space between the circular saw blade 7 and an end of a log. A rail 19 is secured at the top of the log support frame 12 on the side next to the carriage frame 5 under which a roller 20 runs which is secured to the carriage frame 5 to prevent any vertical movement of the carriage frame 5.

As shown in FIG. 2, the cutting blocks 8 are mounted on the top of the frame 12 with the back end block 8 being slideable to allow for logs of different lengths. Each of two dog assemnblies 10 moves vertically up or down on an upright 9. The part of the dog assembly 10 that engages a log to hold it secure while sawing can be moved in or out horizontally to the needed position determined by the size of the log. The blocks 8 have a hole (Ref. FIGS. 4 and 5) bored through both sides at the back through which a long shaft 13 is inserted. Each block 8 has an upright portion 9 which is L shaped, having a groove on each side at its (9) base which runs the full length of the base of the upright portion 9 on the outside. A lever 11 attached to the uprights 9 can be moved back and forth to adjust the block 8 to compensate for log taper. A tongue runs the full length of the block 8 on the inside portion at the top at the flat surface with one tongue on each side. These mate with the groove on the bottom part of the upright portion 9 allowing the upright portion 9 to slide back and forth on the block 8. There is also a rack on the bottom side of the upright portion 9. Just below the grooves reaching the full length of the upright portion 9, the racks engage the pinion which is mounted in each block 8 on the shaft 13 with a key in a keyway. The keyway runs the length of the shaft 13 and the shaft 13 goes through each block 8. Thus when the shaft 13 is turned the upright portion 9 will move back or forth on the blocks 8. The front block 8 is welded in place which prevents any movement of the block 8 which would allow it to move out in front of the circular saw blade 7. The back block 8 has a guide welded to it (8) onto the bottom side against the parallel rails. The guide is at both ends of the block 8, allowing the block 8 to be slideable but preventing any lateral movement of the block 8.

Setworks 15, mounted on a setworks frame 14 which is constructed of a heavy gauge of angle iron, is a ratchet type system operated by manually pulling a hand lever 17. It has a bearing surface graduated in ¼ inch increments with a hole and movable pin at each gradation. A slidable stop on the bearing surface stops the movement of the hand lever 17 when it comes to rest against the pin. The hand operated ratchet wheel 18 located on the end of the shaft 13 at the setworks 15 moves back the uprights 9 on the blocks 8. The shaft 13 extends through the hole 30 (Ref. FIGS. 4 and 5), provided in the blocks 8 and through the ratchet wheel 18 in the setworks 15 which is secured to the shaft 13 by a key and setscrew. On the shaft 13 inside each of the blocks 8 the pinion with a key in the keyway meshes with a rack on the bottom of the uprights 9. When the hand lever 17 is pulled, pawls in the lever assembly 16, engage the ratchet wheel 18 and the ends of the pawls drop into grooves on the ratchet wheel. This is how the log is moved out in front of the circular saw blade 7 so that the desired thickness is sawed.

While not shown in the drawings, a safety panel should be mounted at the operator end of the saw mill to reduce the possibility of the operator coming into contact with the saw.

Not shown in the drawings is a prior art drive for the carriage, which in the preferred embodiment of the invention is a hydraulic motor, powered by a small engine driven power unit, which has a sprocket and chain arrangement for moving said carraige back and forth. A conventional hydraulic gear or vane pump controlled by a directional valve suffices for direction and speed control.

As stated earlier in this specification, the crux of the invention is the carriage 5 with the lumber table 24 which catches each piece of lumber as it is sawn and carries it back to the operator as the operator is positioning the carriage 5, which also carries the circular saw assembly 40, for the next saw cut through a log. The operator controls everything from his station near the hand lever 17, except for installing a log into the dog assemblies 10 as required. The present invention makes it possible for a small tree farmer to cut lumber on a commercial basis with a minimum of investment and without hiring labor. With only one person operating the mill, as opposed to four as a usual miminum for other small mills, it is a much safer operation, as the operator only has to worry about himself, not about other people getting in the way. Experience is a major factor in working safely. Inexperienced help, which is often the best a small scale operator can afford, tends to be accident prone.

These descriptions and drawings were taken from a prototype which meets the objective, which is to provide a circular saw mill that can be efficiently operated by one person. It is to be understood that various changes in the shape, size and arrangement of parts may be made without departing from the spirit of the invention, or the scope of the subjoined claims.

Although the description above contains some specificities, these should not be construed as limiting the scope of the invention but as merely providing illustrations of some of the presently preferred embodiments of this invention.

Thus the scope of the invention should be determined by the appended claims and their legal equivalents rather than by the examples given.

I claim:

1. A circular saw mill operable by one man comprising:

a pair of parallel tracks;

a log support frame located parallel to the tracks for holding a log in a stationary position, said log support frame including a guide rail extending parallel to the tracks;

a saw carriage driven longitudinally, between an operator end and a cut end, along the tracks in parallel with the log held stationary in the log support frame, said saw carriage including a roller for engaging the guide rail of the log support frame for preventing vertical movement of the saw carriage;

an engine powered circular saw assembly mounted on the saw carriage, wherein the engine powered circular saw assembly includes a circular saw blade and a lumber splitter for producing vertical cuts along the log held stationary in the log support frame for producing lumber pieces in various thicknesses;

a lumber table positioned alongside the circular saw assembly for catching the lumber pieces produced by the vertical cuts of the log; and a means for mounting the lumber table to the saw carriage such that the lumber table moves with the saw carriage for delivering the lumber pieces to the operator when the saw carriage returns to the operator end.

2. The circular saw mill of claim 1, further comprising a large pulley mounted to a saw shaft of the circular saw blade and a small pulley mounted to an output shaft of an engine of the engine powered circular saw assembly.

3. The circular saw mill of claim 1, further comprising wheels mounted on the saw carriage for guiding the saw carriage along the tracks and a holding mechanism for securely holding the log on the log support frame.

4. The circular saw mill of claim 3, wherein the holding mechanism comprises:

setworks mounted to the log support frame at the operator end of the circular saw mill for adjusting the thickness of the lumber pieces to be cut, wherein the setworks includes an elongated shaft extending the length of the log support frame, a ratchet wheel and a hand lever;

a pair of support blocks mounted on a top side of the log support frame, wherein each of the blocks include a hole for receiving the elongated shaft, wherein the shaft includes pinions located in the blocks;

a pair of uprights extending vertically from the top side of the log support frame and slidably mounted in the support blocks, wherein each of the uprights include a rack for engaging the pinions on the shaft in the blocks;

a pair of dogs mounted to the uprights; and wherein movement of the hand lever rotates the shaft such that the uprights are moved toward and away from the circular saw assembly thereby adjusting the thickness of the lumber pieces to be cut.

* * * * *